US006808247B2

(12) United States Patent
Kawatoko et al.

(10) Patent No.: US 6,808,247 B2
(45) Date of Patent: Oct. 26, 2004

(54) INK JET RECORDING APPARATUS AND INK JET RECORDING METHOD

(75) Inventors: Norihiro Kawatoko, Kanagawa (JP); Hiroshi Tajika, Kanagawa (JP); Yuji Konno, Kanagawa (JP); Takayuki Ogasahara, Rochester, NY (US); Tetsuya Edamura, Kanagawa (JP); Atsuhiko Masuyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/198,105

(22) Filed: Jul. 19, 2002

(65) Prior Publication Data

US 2003/0025745 A1 Feb. 6, 2003

(30) Foreign Application Priority Data

Jul. 31, 2001 (JP) ..... 2001/232917

(51) Int. Cl.[7] ..... B41J 2/165

(52) U.S. Cl. ..... 347/23; 347/29; 347/30; 347/35

(58) Field of Search ..... 347/14, 19, 23, 347/24, 29, 30, 31, 32, 33, 35; 358/296

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,726,692 A | | 3/1998 | Yamaguchi et al. | 347/23 |
| 5,896,143 A | * | 4/1999 | Matsui et al. | 347/24 |
| 6,325,492 B1 | | 12/2001 | Koitabashi et al. | 347/57 |
| 6,345,878 B1 | * | 2/2002 | Kanaya | 347/23 |

FOREIGN PATENT DOCUMENTS

| | | |
|---|---|---|
| JP | 59-123670 | 7/1984 |
| JP | 59-138461 | 8/1984 |
| JP | 5-69559 | 3/1993 |
| JP | 6-115097 | 4/1994 |
| JP | 6-126982 | 5/1994 |
| JP | 7-266578 | 10/1995 |
| JP | 8-118674 | 5/1996 |

* cited by examiner

*Primary Examiner*—Shih-Wen Hsieh
(74) *Attorney, Agent, or Firm*—Fitzpatrick, Cella, Harper & Scinto

(57) ABSTRACT

An ink jet recording apparatus adjusts at least one of a preliminary discharge time representing a time until the subsequent preliminary discharge is performed and a compensated time determined on the basis of the time elapsed since the previous preliminary discharge, so that the preliminary discharge is performed at a predetermined preliminary discharge hole. Accordingly, the ink jet recording apparatus is capable of recording on different kinds of recording media in a manner suitable for each of them without using a complex control process, and of performing the preliminary discharge according to the size of the recording media. In addition, a reduction in the throughput is prevented by using the ink jet recording apparatus.

23 Claims, 6 Drawing Sheets

| MEDIA SIZE | RECORDING WIDTH (mm) | DRIVING FREQUENCY (KHz) | ACCELERATION TIME (ms) | DECELERATION TIME (ms) | 0 | 0.25 CYCLES (sec) | 0.5 CYCLES (sec) | 0.75 CYCLES (sec) | 1 CYCLE (sec) | 1.25 CYCLES (sec) |
|---|---|---|---|---|---|---|---|---|---|---|
| A4 | 210 | 20 | 60 | 60 | 0 | 0.31 | 0.62 | 0.92 | 1.23 | 1.50 |
| A3 | 279 | 20 | 60 | 60 | 0 | 0.39 | 0.78 | 1.17 | 1.56 | 1.89 |
| PRELIMINARY DISCHARGE HOLE TO BE USED | | | | | HP | OPPOSITE HP | | | | HP |

FIG. 3

| | | HIGH SPEED ←→ HIGH QUALITY | | |
|---|---|---|---|---|
| GRADE | MEDIA | PLAIN | COATED | GLOSSY |
| (HIGH SPEED) | 0 | 10 | 5 | 0.9 |
| | 1 | 10 | 5 | 0.9 |
| | 2 | 10 | 5 | 0.9 |
| | 3 | 10 | 5 | 0.9 |
| (HIGH QUALITY) | 4 | 5 | 0.9 | 0.9 |

FIG. 4

| | | HIGH SPEED ←→ HIGH QUALITY | | |
|---|---|---|---|---|
| GRADE | MEDIA | PLAIN | COATED | GLOSSY |
| (HIGH SPEED) | 0 | 10 | 1.4 | 1.1 |
| | 1 | 10 | 1.4 | 1.1 |
| | 2 | 10 | 1.4 | 1.1 |
| | 3 | 10 | 1.4 | 1.1 |
| (HIGH QUALITY) | 4 | 5 | 0.9 | 0.9 |

| | | HIGH SPEED ←→ HIGH QUALITY | | |
|---|---|---|---|---|
| GRADE | MEDIA | PLAIN | COATED | GLOSSY |
| (HIGH SPEED) | 0 | 10 | 5 | EVERY LINE |
| | 1 | 10 | 5 | EVERY LINE |
| | 2 | 10 | 5 | EVERY LINE |
| | 3 | 10 | 5 | EVERY LINE |
| (HIGH QUALITY) | 4 | 5 | EVERY LINE | EVERY LINE |

INK JET RECORDING APPARATUS AND INK JET RECORDING METHOD

BACKGROUND OF THE INVENTION

1. Field of the Invention

The present invention relates to ink jet recording apparatuses and ink jet recording methods, and more specifically relates to an ink jet recording apparatus and an ink jet recording method in which preliminary discharge is performed.

2. Description of the Related Art

Hitherto, serial scan type recording apparatuses in which a recording operation is performed while a recording head scans over a recording medium have been commonly used for forming various types of images. In particular, ink jet recording apparatuses have recently come into widespread use because of their small size and ability to form color images easily.

In ink jet recording apparatuses, a plurality of nozzles are formed in a recording head, and recording is performed by discharging ink droplets from the nozzles.

In such ink jet recording apparatuses, nozzles to be used for discharging the ink droplets are determined in accordance with image data. Therefore, if there are nozzles which are not often used during recording, the ink with which they are filled evaporates and the viscosity thereof increases. In such a case, there is a risk that a normal discharge operation cannot be performed the next time the nozzles are used. In order to prevent this, a discharge operation called a preliminary discharge is performed even in unused nozzles at predetermined intervals of time. In the preliminary discharge, the ink is discharged toward an ink-absorbing hole (hereinafter also called a "preliminary discharge hole") positioned at a region outside a recording area, so that the viscosity of the ink with which the nozzles are filled does not increase excessively.

On the other hand, in order to satisfy the recent requirements for high-resolution recording, a method has been suggested in which the resolution is increased by reducing the volume of ink droplets discharged from each nozzle and accordingly reducing the size of the dots formed. When the size of the ink droplets discharged from each nozzle decreases, the internal volume of the nozzles also decreases. Therefore, the amount of ink with which each nozzle is filled is reduced, so that the ink quickly evaporates and the viscosity thereof increases in a short time. As a result, the preliminary discharge must be performed more frequently at shorter time intervals. As the number of times the preliminary discharge, which is not directly relevant to the recording operation, is performed increases, the recording throughput decreases.

Accordingly, various suggestions for performing the preliminary discharge more efficiently have been made.

For example, according to Japanese Patent Laid-Open No. 06-115097, the preliminary discharge hole is formed at the same position as a run-up start position of a carriage in order to prevent the reduction in the throughput.

In addition, according to Japanese Patent Laid-Open No. 06-126982, in order to perform the preliminary discharge more efficiently, whether or not the preliminary discharge is necessary is determined by comparing the time elapsed since the previous preliminary discharge and the time until recording starts. In addition, according to Japanese Patent Laid-Open No. 07-266578, the preliminary discharge is more efficiently performed in the case in which the kinds of inks having different aridities are used. As described above, various suggestions for performing the preliminary discharge more efficiently have been made.

In addition, various kinds of methods for performing the preliminary discharge may be used in accordance with the conditions, and the time at which the preliminary discharge is performed may also be changed in accordance with the conditions.

Although the maximum recording width of many ink jet recording apparatuses is that of the A4 size, some ink jet recording apparatuses are capable of recording up to the A3 size. As described above, the preliminary discharge hole is positioned outside the recordable area in the scanning direction of the recording head. Accordingly, in recording apparatuses whose recording width is large, even when, for example, A4-size recording is performed, the recording head moves over a range corresponding to the A3 size or more when the preliminary discharge is performed. Therefore, recording speed is lower than that of recording apparatuses whose maximum recording size is A4 size.

In order to solve the above-described problem, Japanese Patent Laid-Open No. 05-069559 discloses an ink let recording apparatus in which preliminary discharge holes are formed at positions corresponding to size of recording media in addition to a home position and an opposite home position.

However, it is preferable not to provide a plurality of preliminary discharge modes since different preliminary discharge methods must be used and the control thereof becomes complicated.

In addition, when the preliminary discharge holes are formed at positions corresponding to paper sizes, the preliminary discharge hole to be used must be changed in accordance with the paper size. Therefore, the construction of the apparatus and scan control of the recording head become complex.

SUMMARY OF THE INVENTION

In view of the above, an object of the present invention is to provide an ink jet recording apparatus which is capable of performing preliminary discharge for maintaining the state of a recording head without a complex control process in order to record on different kinds of recording media in a manner suitable for each of them, which performs the preliminary discharge according to the size of the recording media without a complex mechanism, and with which a reduction in the throughput can be prevented.

According to one aspect of the present invention, an ink jet recording apparatus which records on a recording medium by moving a recording head having discharge outlets for discharging an ink and which performs preliminary discharges at a plurality of preliminary discharge positions, includes a preliminary-discharge-time setting unit which sets a time interval at which the preliminary discharges are performed; an elapsed-time counting unit which counts the time elapsed since the previous preliminary discharge of the recording head; and a comparing unit which compares a time determined on the basis of the elapsed time counted by the elapsed-time counting unit and the time interval set by the preliminary-discharge-time setting unit and outputs a preliminary discharge command when the elapsed time reaches the set time interval. A preliminary discharge is performed at a predetermined preliminary discharge position selected from the plurality of preliminary discharge positions by adjusting at least one of the set time interval and the time determined on the basis of the elapsed time.

In addition, according to another aspect of the present invention, an ink jet recording method by which an operation of recording on a recording medium is performed by moving a recording head having discharge outlets for discharging an ink and which performs preliminary discharges at a plurality of preliminary discharge positions, includes a preliminary-discharge-time setting step in which a time interval at which the preliminary discharges are performed is set; an elapsed-time counting step in which the time elapsed since the previous preliminary discharge of the recording head is counted; and a comparing step in which a time determined on the basis of the elapsed time counted in the elapsed-time counting step and the time interval set in the preliminary-discharge-time setting step are compared and a preliminary discharge command is output when the elapsed time reaches the set time interval. A preliminary discharge is performed at a predetermined preliminary discharge position selected from the plurality of preliminary discharge positions by adjusting at least one of the set time interval and the time determined on the basis of the elapsed time.

In addition, according to another aspect of the present invention, an ink jet recording apparatus which records on a recording medium by moving a recording head having discharge outlets for discharging an ink and which performs preliminary discharges at a plurality of preliminary discharge positions, the ink jet recording apparatus comprising a unit for switching a preliminary discharge position where the preliminary discharges are performed over the plurality of preliminary discharge positions in accordance with a recording mode.

According to the above-described construction, since the preliminary discharges are performed at the time interval set by the preliminary-discharge-time setting unit, the preliminary discharge hole can be selected in accordance with the recording medium by adjusting the time interval. This time interval is set to an adequate value by determining the time required for the recording head to reach a predetermined position above the recording, and predicting the movement of the recording head on the basis of the determined time.

Further objects, features and advantages of the present invention will become apparent from the following description of the preferred embodiments( with reference to the attached drawings).

BRIEF DESCRIPTION OF THE DRAWINGS

FIG. 3 is a table showing the relationship between arrival times of a recording head at various positions above A4-size and A3-size recording media and positions of preliminary discharge holes used for preliminary discharge.

FIG. 4 is a table showing preliminary discharge time according to a first embodiment of the present invention.

DESCRIPTION OF THE PREFERRED EMBODIMENTS

Embodiments of the present invention will be described below with reference to the accompanying drawings.

An ink jet recording apparatus is connected to a host computer such as a personal computer and starts a recording operation when it receives a record command and record data from the host computer.

Figure 1:
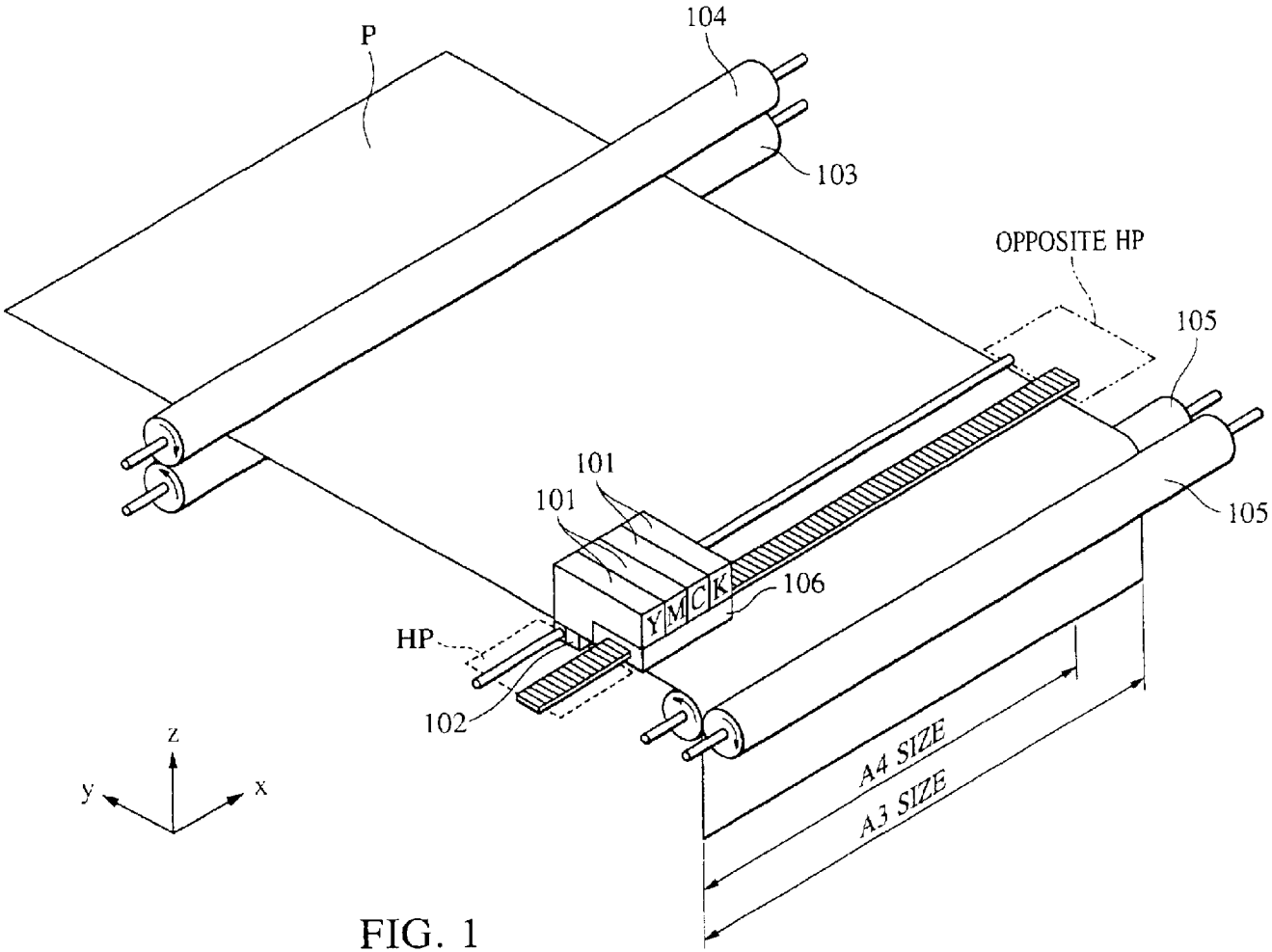
FIG. 1 is a perspective view of an ink jet recording apparatus according to embodiments of the present invention.

FIG. 1 is a perspective view of an ink jet recording apparatus according to the embodiments of the present invention.

In FIG. 1, reference numeral 101 denotes ink cartridges. Each of the ink cartridges 101 contains an ink tank and a recording head 102, and the ink tanks of the ink cartridges 101 contain black, cyan, magenta, and yellow inks. A plurality of discharge outlets are formed in each recording head 102, and ink droplets are discharged from each discharge outlet during the recording operation.

Reference numeral 103 denotes a conveying roller which rotates in a direction shown by the arrow in FIG. 1 while pressing a recording medium P against an auxiliary roller 104, so that the recording medium P is transferred in the y direction in FIG. 1. In addition, reference numeral 105 denotes feed rollers which feed the recording medium P while pressing it, similarly to the conveying roller 103 and the auxiliary roller 104. Reference numeral 106 denotes a carriage which supports the ink cartridges 101 and moves them in the x direction during the recording operation. When the recording operation is not performed or when a recording-head recovery operation is performed, the carriage 106 stays at a home position (HP) shown by the dashed lines in FIG. 1. When the carriage 106 receives a record start command while staying at the home position, it starts to move in the x direction while the recording heads 102 record on the recording medium P. Then, when the carriage 106 reaches the opposite end of the recording medium P, the conveying roller 103 conveys the recording medium P by a predetermined distance. The operation of recording on the recording medium P is performed by repeating the recording step and the conveying step.

Preliminary discharge holes are formed at the home position (HP) and a position opposite to the home position in the main-scanning direction (hereinafter referred to as an "opposite home position (opposite HP)"), and the preliminary discharge is performed at positions where the preliminary discharge holes are formed. In FIG. 1, the preliminary discharge hole formed at the home position is shown by the dashed line, and the preliminary discharge hole formed at the opposite home position is shown by the two-dot chain line.

Figure 2:
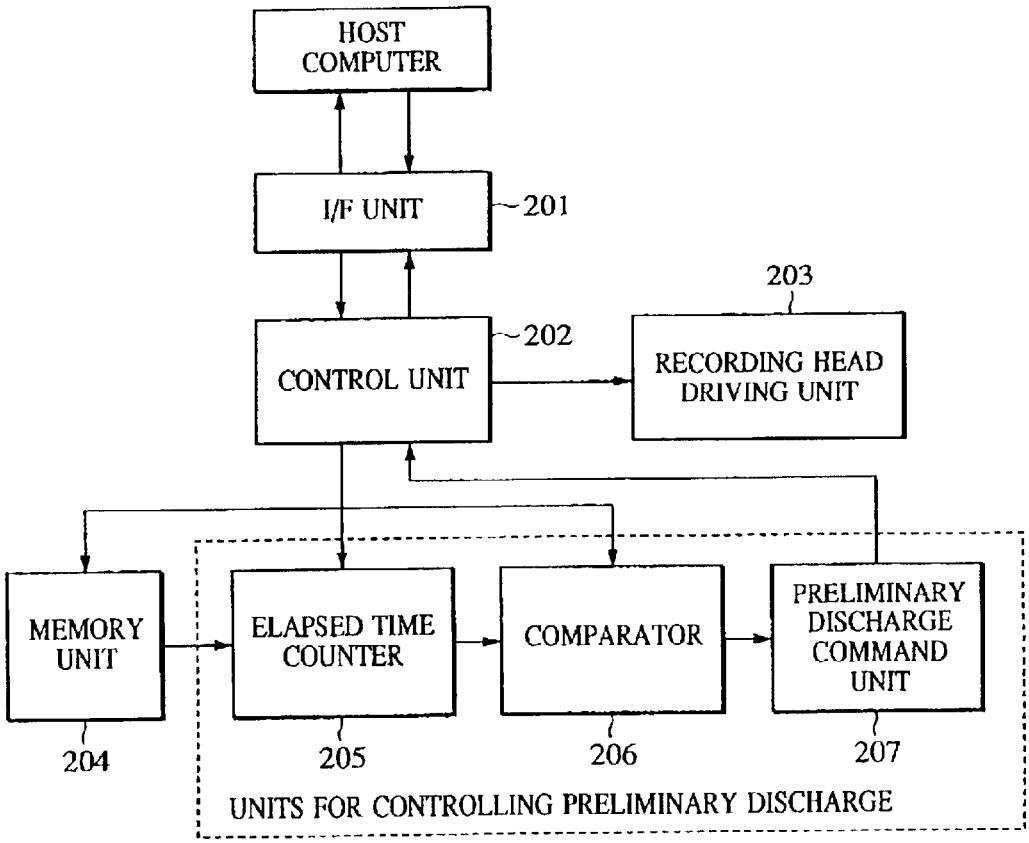
FIG. 2 is a block diagram showing the electrical construction of the ink jet recording apparatus according to the embodiments of the present invention.

FIG. 2 is a block diagram showing the electrical construction of the ink jet recording apparatus. With reference to FIG. 2, the ink jet recording apparatus includes an interface unit 201 which communicates data with the host computer, a control unit 202 which controls the overall apparatus, a recording head driving unit 203 which drives the recording head, a memory unit 204 which stores programs and data necessary for various operations, and other units used for controlling the preliminary discharge.

The units for controlling the preliminary discharge include an elapsed time counter 205 which counts the time elapsed since the previous preliminary discharge, a comparator 206 which compares the elapsed time and a preliminary discharge time which is set in advance, and a preliminary discharge command unit 207 which transmits a request for performing the preliminary discharge to the control unit 202 according to the result obtained by the comparator 206.

The inventors of the present invention have discovered that a suitable preliminary discharge method differs in accordance with the kind of recording media, and the preliminary discharge method is preferably selected in accordance with the kind of recording media. For example, when using recording media for which image quality is important, such as glossy paper, the preliminary discharge is preferably performed frequently. However, when using recording media for which image quality does not strongly affect the appearance, such as plain paper, it is not necessary to perform the preliminary discharge as frequently as in the case in which glossy paper is used. Since the ink will be wasted if the preliminary discharge is performed similarly for all kinds of recording media, the preliminary discharge method is selected in accordance with the kind of recording media. When using plain paper, since irregular recording is not easily noticeable, a time-based preliminary discharge method which places importance on recording speed is applied, and when using glossy paper, since image quality is important, an every-line preliminary discharge method in which the preliminary discharge is performed before every scan is preferably applied.

Figures 6, 7, 8:
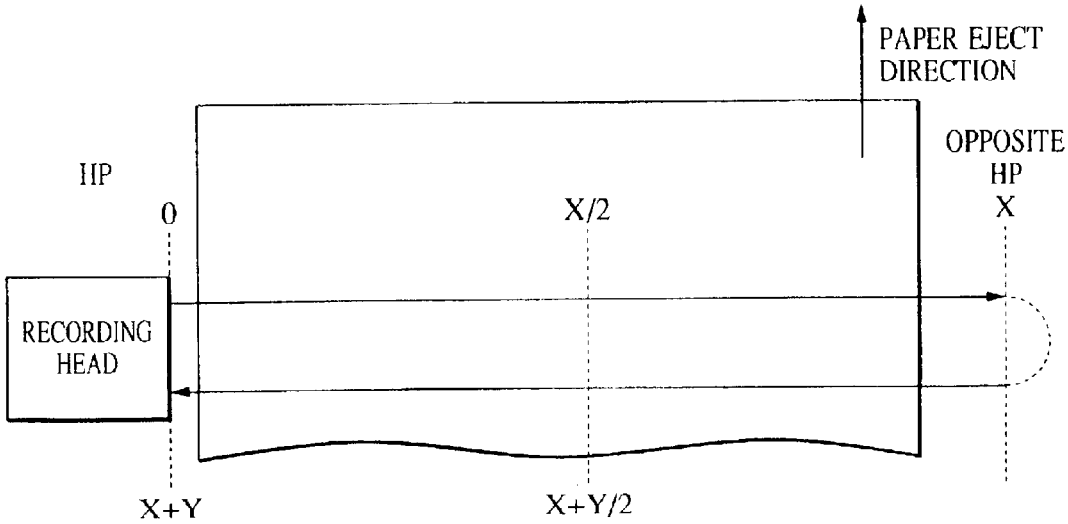
FIG. 6 is a table sowing preliminary discharge time according to a second embodiment of the present invention.
FIG. 7 is a table showing an example of the preliminary discharge time.
FIG. 8 is a diagram showing a manner in which the recording head moves in a single scan.

FIG. 7 is a table showing an example of the preliminary discharge time which is set in accordance with the kind of recording medium.

FIG. 8 is a diagram showing the manner in which the recording head moves in a single scan.

When using recording media for which image quality is important, such as glossy paper, the every-line preliminary discharge mode, in which the preliminary discharge is performed before every scan, is selected. The term "every line" shown in the column "glossy" in FIG. 7 indicates that the every-line preliminary discharge mode is selected.

In addition, when using the recording media for which image quality is important, satisfactory image quality is obtained even without the preliminary discharge for a single scan, but image quality is degraded compared to the first scan if a second scan is then performed without performing the preliminary discharge.

The operation of the every-line preliminary discharge mode will be described below.

With reference to FIG. 8, the preliminary discharge holes are formed at two positions: the home position and the opposite home position. When the recording head performs bidirectional recording, that is, when recording is performed while the recording head moves away from the home position (from 0 to X) and also when the recording head returns to the home position (from X to X+Y), a preliminary discharge is performed at the home position before the recording head starts recording from the home position. Then, when the recording head reaches the X position, a preliminary discharge is performed again at the opposite home position before the recording head leaves the opposite home position.

When using recording media in which image quality does not strongly affect the appearance, such as plain paper, importance is placed on recording speed over image quality. Accordingly, the preliminary discharge is not performed before every scan but is performed at longer time intervals in the time-based preliminary discharge mode. The numeral "10" shown in the column "plain" in FIG. 7 indicates that a preliminary discharge is performed every 10 seconds.

The operation of the time-based preliminary discharge mode has five grades (0, 1, 2, 3, and 4). As the number increases, greater importance is placed on image quality. Accordingly, even when the same kind of recording medium, for example, plain paper, is used, the user is able to select from five grades in accordance with his or her performance between speed and image quality. For example, when the grade is "4", image quality is given priority over speed even when plain paper is used, and therefore the time interval for preliminary discharges is reduced to 5 seconds so that preliminary discharges are more frequently performed.

Next, the operation of the time-based preliminary discharge mode in accordance with the above-described grades will be described below.

When, for example, the recording head starts recording from the home position, the time elapsed since leaving the home position is counted, and when the counted time reaches the predetermined preliminary discharge time, a preliminary discharge is performed at the preliminary discharge hole selected according to the location of the carriage at that time.

When the predetermined preliminary discharge time is set to 10 seconds for plain paper, as shown in FIG. 7, it means that the first preliminary discharge is performed 10 seconds after the recording head has left the home position.

As described above, in the time-based preliminary discharge method, the time for performing the preliminary discharge is determined only on the basis of the time elapsed since the previous preliminary discharge, irrespective of the movement of the carriage. Therefore, as the preliminary discharge time increases, the interval between preliminary discharges increases, so that the number of times the preliminary discharge is performed for a single page decreases. Accordingly, the recording time also decreases.

Preliminary discharge control according to the present invention will be described below in detail.

First Embodiment

According to the present embodiment, the interval between preliminary discharges (the preliminary discharge time) is set in advance in accordance with the kind of recording media (or the recording mode). The interval of the preliminary discharge (the preliminary discharge time) may be set when the apparatus is shipped, or it may also be changed freely by the user by using a printer driver, etc.

Although two kinds of preliminary discharge modes, that is, the every-line preliminary discharge mode and the time-based preliminary discharge mode, are used in accordance with the kind of recording media in the above-described example, only the time-based preliminary discharge mode is used in the present embodiment. When using recording media for which image quality is important, the preliminary discharge is practically performed before every scan by suitably setting the interval between preliminary discharges.

In the present embodiment, the times necessary for the carriage to complete a single cycle and to reach the intermediate points of a single cycle, that is, X/2, X, X+Y/2, and X+Y (see FIG. 8) are calculated or measured in advance for each recording media size in the design phase or before the apparatus is shipped. The calculation (or measurement) results are stored in the memory unit.

FIG. 3 is a table showing the times required for the carriage to reach each of the intermediate points above A4-size and A3-size recording media, which are stored in the memory unit.

The constant moving speed of the carriage is 423.3 mm/s (when the recording operation is performed in a 1200 dpi grid at a discharge frequency of 20 KHz), and the time required for the carriage to reach the constant moving speed and the time required for the carriage moving at the constant moving speed to stop is 0.06 sec. In this case, the times required for the carriage to reach the points X/2, X, X+Y/2, and X+Y of the A4 size recording width (210 mm) are 0.31, 0.62, 0.92, and 1.23 seconds, respectively.

In the present embodiment, the preliminary discharge time is set as described below by taking into account the times required for the carriage to reach the above-described points.

FIG. 4 is a table showing the preliminary discharge time according to the present embodiment.

When using glossy paper for which image quality is important is used, the preliminary discharge time is set to a value between the times required for the carriage to reach the points X/2 and X+Y/2 shown in FIG. 8. More specifically, with reference to FIG. 3, when the carriage speed is 423.3 mm/s and the recording width is that of the A4 size, the carriage reaches the region from 0.25 to 0.75 cycles in 0.31 to 0.92 seconds. Accordingly, in the present embodiment, the preliminary discharge time is set to 0.9 for glossy paper, as shown in FIG. 4. That is, preliminary discharges are performed at time intervals of 0.9 seconds. According to this setting, even though the time-based preliminary discharge mode is selected, a preliminary discharge is practically performed for every line by the following process.

Figure 5:
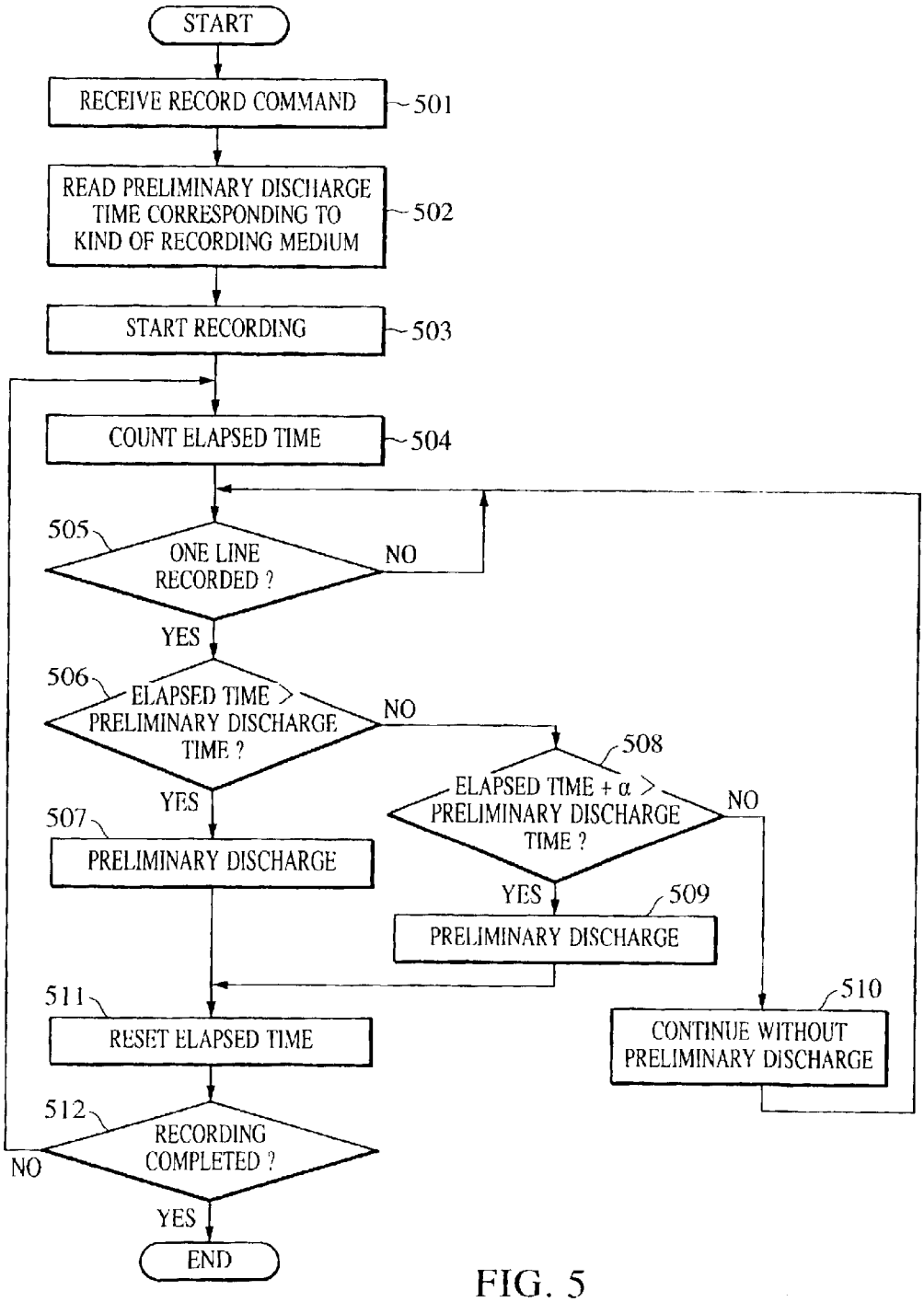
FIG. 5 is a flowchart of a preliminary discharge process according to the embodiments of the present invention.

FIG. 5 is a flowchart showing the preliminary discharge process according to the present embodiment.

First, the control unit receives a record command from the host computer (Step 501), and reads out preliminary discharge time data (see FIG. 4) from the memory unit in accordance with the kind of recording medium set in a paper feeder (Step 502). Then, the control unit starts the recording operation on the basis of image data transmitted from the host computer (Step 503) and the elapsed time counter starts counting the elapsed time (Step 504).

When recording of one line is completed (Step 505), that is, when, for example, the carriage reaches the opposite home position after starting from the home position, the comparator determines whether or not the elapsed time is longer than the preliminary discharge time which is set in advance (Step 506). When the elapsed time is longer than the preliminary discharge time, a preliminary discharge is performed at the preliminary discharge hole formed at the side at which the carriage has reached (Step 507). When the elapsed time is not longer that preliminary discharge time, the comparator determines whether or not the sum of the elapsed time and a predetermined time $\alpha$ is longer than the preliminary discharge time (Step 508). When the sum of the elapsed time and the predetermined time $\alpha$ is longer than the preliminary discharge time, a preliminary discharge is performed (Step 509). When the sum of the elapsed time and the predetermined time $\alpha$ is not longer than the preliminary discharge time, the subsequent line is recorded without performing a preliminary discharge (Step 510). The predetermined time $\alpha$ is determined in accordance with the times required for the carriage to reach the above-described points of a single cycle (see FIG. 3). In the present embodiment, when it is expected that the preliminary discharge time will be reached while the carriage is in the region from X/2 to X+Y/2, a preliminary discharge is performed at the opposite home position, and when it is expected that the preliminary discharge time will be reached while the carriage is in the region including X+Y/2 to X+Y (0) and X+Y (0) to X/2, a preliminary discharge is performed at the home position. Therefore, when the carriage reaches the opposite home position, it must be determined whether or not the preliminary discharge time will be reached while the carriage is in the region from X to X+Y/2. In addition, when the carriage reaches the home position, whether or not the preliminary discharge time will be reached while the carriage is in the region from 0 to X/2 must be determined. In order to determine this, the time required for the carriage to move one-fourth of a single cycle (0 to X to Y) is set as $\alpha$ and the sum of the elapsed time and $\alpha$ is compared to the preliminary discharge time. Although a single cycle is divided into two regions, that is, the region including X/2 to X and X to X+Y/2 and the region including X+Y/2 to X+Y (0) and X+Y (0) to X/2 in the present embodiment, it may also be divided into the region from 0 to X and the region from X to X+Y (0). A preliminary discharge may be performed at the position of the carriage before the preliminary discharge time is reached, or it may be performed at the position of the carriage after the preliminary discharge time is reached. Either one of the above-mentioned times may be chosen in accordance with balance between the throughput of the recording operation and the reliability of image quality which is maintained by performing preliminary discharges.

In addition, when a preliminary discharge is performed at Step 507 or 509, the elapsed time is reset (Step 511). Then, the process returns to Step 504 and the recording operation and preliminary discharges are repeated until the recording operation is completed (Step 512).

In the above-described case where glossy paper is used, the preliminary discharge time is set to 0.9 seconds (see FIG. 4). In such a case, a preliminary discharge is performed as described below.

When, for example, the A4-size recording media are used, it requires 0.62 seconds for the carriage to start from the home position, record one line, and reach the opposite home position (see FIG. 3). Since the elapsed time is shorter than the preliminary discharge time, the sum of the elapsed time and $\alpha$ and the preliminary discharge time are compared. When, for example, $\alpha$ is 0.31, the condition 0.62+0.31=0.93>0.9 is satisfied, so that a preliminary discharge is performed at the preliminary discharge hole formed at the opposite home position, where the carriage is currently positioned. Then, the elapsed time is reset, and recording is performed while the carriage returns to the home position. When the carriage reaches the home position, the elapsed time is approximately 0.62 seconds. In a similar manner, the elapsed time and the preliminary discharge time are compared, and then the sum of the elapsed time and a and the preliminary discharge time are compared. Since the condition 0.62 (approximately)+0.31=0.93 (approximately) >0.9 is satisfied, a preliminary discharge is also performed at the preliminary discharge hole formed at the home position. More specifically, even though the time-based preliminary discharge method is applied, the preliminary discharge operation is practically performed for every line by setting the preliminary discharge time to 0.9 seconds.

Since a preliminary discharge is not performed until the elapsed time reaches a time close to 0.9 seconds according to the present embodiment, a preliminary discharge may not be performed for every line, depending on the recording region, and there may be a case where the preliminary discharge is performed once every few lines.

In addition, although the present embodiment merely shows an example of a processing sequence of the time-based preliminary discharge mode, various other sequences may also be used as long as the preliminary discharge operation is practically performed for every line.

In addition, although the preliminary discharge hole at which the preliminary discharge is performed is determined on the basis of both the comparison between the preliminary discharge time and the elapsed time and the comparison between the preliminary discharge time and the sum of the elapsed time and the predetermined time $\alpha$, it may also be determined on the basis of either one of them.

Second Embodiment

In the first embodiment, the preliminary discharge time is set according to the kind of recording media (see FIG. 4).

On the other hand, in the apparatus shown in FIG. 1, which is capable of recording on both A3-size and A4-size recording media, there is a large distance between an end of the A4-size recording area and the preliminary discharge hole formed at the opposite home position. Therefore, when, for example, it is determined that a preliminary discharge is to be performed at the opposite home position when recording on A4-size recording medium, the carriage must move an extra distance. Accordingly, as described above, the throughput decreases compared to the recording apparatuses which record only on A4-size recording media. Accordingly, in the present embodiment, the preliminary discharge time is set such that the position of the preliminary discharge is determined not only in accordance with the kind of recording media but also with the size thereof.

The construction of the ink jet recording apparatus and the processing sequence for the time-based preliminary discharge operation are similar to those described in the first embodiment.

FIG. 6 is a table showing the preliminary discharge time according to the present embodiment.

In the present embodiment, the preliminary discharge time is set to a time common to both A3-size and A4-size recording media such that the preliminary discharge time is reached at the home position for the A4-size recording medium and at the opposite home position for the A3-size recording medium. More specifically, with reference to the column "glossy" and the rows of grades 0 to 3, the preliminary discharge time is set to 1.1. As is understood from the table shown in FIG. 3, when the size of the recording medium is A3, the carriage is in the region from 0.5 to 0.75 cycles (that is, the region from X to X+Y/2) at this time. Accordingly, when the carriage recording on the A3-size recording medium reaches the opposite home position, it is expected that the elapsed time will reach 1.1 seconds while the carriage is in the region from X to X+Y/2, so that the preliminary discharge is performed at the opposite home position.

On the other hand, if the size of the recording medium is A4, the carriage is in the region from 0.75 to 1 cycle (that is, the region from X+Y/2 to X+Y) when the elapsed time reaches 1.1 seconds. Therefore, a preliminary discharge is performed at the home position. As described above, the preliminary discharge time is calculated such that even for the same kind of recording media, a preliminary discharge for the A4-size recording media is performed at the home position on the basis of the times required for the carriage to reach each point. In the present embodiment, the preliminary discharge time is set to a time such that the carriage is in the region including X+Y/2 to X+Y (0) and X+Y (0) to X/2 when recording on A4-size recording media and in the region including X/2 to X and X to X+Y/2 when recording on A3-size recording media.

By setting the preliminary discharge time as described above, although the same processing sequence as that shown in FIG. 5 is used, the preliminary discharge hole at which the preliminary discharge is performed can be changed in accordance with the size of the recording medium. Since a preliminary discharge for the A4-size recording media is performed at the home position, the carriage does not have to move to the preliminary discharge hole formed at the opposite home position when recording on A4 recording media. Accordingly, the reduction in the throughput can be prevented.

For glossy paper, and grade 4 quality, the preliminary discharge time is set to 0.9 seconds. When a preliminary discharge is performed at time intervals of 0.9 seconds, a preliminary discharge operation is practically performed for every line as described above in the first embodiment, and the nozzles can be reliably maintained in a good state.

When a recording medium which is not strong but which receives a large amount of ink droplets, for example, coated paper, is used, there is a risk that the recording medium will curl up at the end. In such a case, the recording head may slide on the raised portion of the recording medium, or worse, the side of the recording head may come into contact with the recording medium and the recording medium will become jammed under the recording head. Since the movement of the recording head is impeded when the recording medium is jammed thereunder, this must be reliably prevented. When the recording head moves to the opposite home position for a preliminary discharge and becomes separated from the recording medium, the possibility that the recording head will come into contact with the curled end of the recording medium increases. Accordingly, in order to prevent the collision of the recording medium and the recording head, the end portion of the recording head preferably should not become separated from the recording medium by a large distance. The recording head can be prevented from becoming separated from the end portion of the recording medium by performing a preliminary discharge at the home position for both A3-size and A4-size recording media.

In the present embodiment, when coated papers are used and the grade is 0 to 3, the preliminary discharge time is set to 1.4 seconds, so that the preliminary discharge is always performed at the home position. When the elapsed time reaches 1.4 seconds, the carriage is in the region from 1 to 1.25 cycles, that is, the region from 0 to X/2, if the size is A4, and is the region from 0.75 to 1 cycle, that is, the region from X+Y/2 to X+Y, if the size is A3. Therefore, the preliminary discharge is performed at the home position for both sizes.

The recording medium also curls easily when the recording is performed from end to end of a recording medium as in marginless recording. Accordingly, the preliminary discharge time may also be set such that preliminary discharges are performed only at the home position in accordance with whether the marginless recording is performed. Furthermore, since the recording medium easily curls especially at the top and the bottom ends thereof, the preliminary discharge time may be changed at regions close to the top and the bottom ends of the recording medium.

Accordingly, by applying the present invention, a suitable preliminary discharge hole is selected from multiple preliminary discharge holes according to the kind and size of the recording medium, without using a complex control process, merely by setting the preliminary discharge time.

In the above-described embodiments, the preliminary discharge hole to be used is determined on the basis of the expected position of the recording head when the time elapsed since the previous preliminary discharge operation reaches the preliminary discharge time. When a reciprocating cycle is divided into four sections, if the recording head is expected to be in the region from 0 to 0.25 cycles or 0.75 to 1 cycles, the preliminary discharge hole formed at the home position side is used, and if the recording head is expected to be in the region from 0.25 to 0.75 cycles, the preliminary discharge hole formed at the opposite home position is used. However, the present invention may of course be applied to a case in which the processing sequence is simplified by using the preliminary discharge hole formed at the home position for 0 to 0.5 cycles and using the preliminary discharge hole formed at the opposite home position for 0.5 to 1 cycle.

According to the above-described embodiments, the switching operation between the every-line preliminary discharge mode and the time-based preliminary discharge mode can be omitted, and a preliminary discharge is performed simply by using only the time-based preliminary discharge mode. In addition, a suitable preliminary discharge hole is selected from multiple preliminary discharge holes in accordance with the kind and size of the recording medium, without a complex control process, merely by setting the preliminary discharge time.

By suitably setting the preliminary discharge time in accordance with the kind of recording media, the preliminary discharge can be practically performed for every line.

In addition, by applying the present invention, a reduction in throughput may be prevented when A4-size recording is performed using a recording apparatus capable of recording on A3-size recording media.

Others

The present invention achieves an excellent effect when applied to a recording head or a recording apparatus which includes a mechanism for generating thermal energy (for example, electrothermal transducers, laser beams, etc.), and which causes a change in the state of ink by the thermal energy so as to discharge the ink. Such a system achieves high density and high resolution recording.

A typical structure and operational principle of the above-described system is disclosed in U.S. Pat. Nos. 4,723,129 and 4,740,796, and it is preferable to use this basic principle. Although this system is applicable to both the so-called on-demand type or continuous type ink jet recording systems, it is particularly suitable for the on-demand type apparatus. In on-demand type inkjet apparatuses, electrothermal transducers are positioned in correspondence with sheets or liquid passages which contain liquid (ink), and one or more drive signals corresponding to recording information are applied to the electrothermal transducers so that a sudden temperature rise that exceeds nucleate boiling occurs. Accordingly, thermal energy is generated by the electrothermal transducers and film boiling occurs on the heating surface of the recording head. As a result, bubbles are generated in the liquid (ink), the bubbles having one-to-one correspondence with the drive signals. Growth and shrinkage of the bubbles are used for discharging the liquid (ink) from one or more ink-discharge outlets in the form of one or more ink droplets. The drive signals are preferably applied in the form of pulses since the bubbles instantaneously and suitably grow or shrink by using the pulse-type drive signals and the response time of the liquid (ink) discharge operation can be reduced. As the pulse-type driving signals, those described in U.S. Pat. Nos. 4,463,359 and 4,345,262 are suitably used. In addition, the recording operation can be further improved by using conditions used in U.S. Pat. No. 4,313,124, which relates to the rate of temperature rise of the above-described heating surface.

The constructions of the recording heads to which the present invention can be applied include those disclosed in U.S. Pat. Nos. 4,558,333 and 4,459,600 in which the heating portions are arranged in bent areas, in addition to the constructions disclosed in the patents listed above in which discharge outlets, liquid passages, and electrothermal transducers are combined (linear liquid passages or rectangular liquid passages). The present invention can also be effectively applied to a construction disclosed in Japanese Patent Laid-open No. 59-123670 in which a slit common to a plurality of electrothermal transducers is used as the discharge outlets of the electrothermal transducers and to a construction disclosed in Japanese Patent Laid-open No. 59-138461 in which openings used for absorbing pressure waves caused by the thermal energy are formed in correspondence with the discharge outlets. Thus, irrespective of the construction of the recording head, the recording operation can be reliably and efficiently performed by applying the present invention.

The present invention can be applied to various kinds of serial type recording heads. For example, the present invention may be applied to a recording head fixed to the main body the recording apparatus, an exchangeable chip type recording head which is electrically connected to the main body of the recording apparatus and is supplied with ink therefrom when it is installed in the main body of the recording apparatus, a cartridge type recording head which is integrally formed with an ink tank, etc.

In the recording apparatus of the present invention, a recovery system, a preliminary auxiliary system, etc., for the discharge operation of the recording head are preferably provided since the effects of the present invention can be more reliably obtained. More specifically, a capping unit and a cleaning unit for the recording head, a pressure or suction unit, a preliminary heating unit which utilizes the electrothermal transducers, other heating elements, or combinations thereof, etc. may be used.

With respect to the kind and number of recording heads mounted on the recording apparatus, only one recording head may be provided for a single color, or a plurality of recording heads may be used for a plurality of inks of different colors and concentrations. Accordingly, the present invention is effectively applied not only to a recording apparatus for a monochrome recording in which only one major color such as black is used, but also to a recording apparatus which is capable of at least one of multi-color and full-color mode recording operations, irrespectively of whether the recording head is formed as a single integral unit or as a combination of multiple heads.

Furthermore, the present invention may be applied to inkjet recording apparatuses installed in a copy machine along with a reader or in a facsimile machine having transmit/receive function, etc., in addition to those used as image output terminals for information processing equipment such as computers.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink jet recording apparatus which records on a recording medium by moving a recording head having discharge outlets for discharging an ink and which performs preliminary discharges at a plurality of preliminary discharge positions, the ink jet recording apparatus comprising:

preliminary-discharge-time setting means which sets a time interval at which the preliminary discharges are performed;

elapsed-time counting means which counts the time elapsed since the previous preliminary discharge of the recording head; and comparing means which compares a time determined on the basis of the elapsed time counted by the elapsed-time counting means and the time interval set by the preliminary-discharge-time setting means and outputs a preliminary discharge command when the elapsed time reaches the set time interval, wherein a preliminary discharge is performed at a predetermined preliminary discharge position selected from the plurality of preliminary discharge positions on the basis of at least one of the set time interval and the time determined on the basis of the elapsed time.

2. A recording apparatus according to claim 1, wherein the preliminary-discharge-time setting means sets the time interval by taking into account the time required for the recording head to reach a predetermined position outside the recording medium.

3. A recording apparatus according to claim 1, wherein a plurality of recording modes are used and the preliminary-discharge-time setting means sets the time interval in accordance with the recording modes.

4. A recording apparatus according to claim 3, wherein when recording is performed in a marginless recording mode, in which recording is performed without leaving a margin in the recording medium in a scanning direction of the recording head, the preliminary-discharge-time setting means sets the time interval such that the preliminary discharges are performed only at the preliminary discharge position at a home position.

5. A recording apparatus according to claim 1, wherein the preliminary-discharge-time setting means sets the time interval to a short time when using a recording medium for which image quality is important.

6. A recording apparatus according to claim 1, wherein the preliminary-discharge-time setting means sets the time interval to a long time when using a recording medium for which recording speed is important.

7. A recording apparatus according to claim 1, wherein the preliminary-discharge-time setting means sets the time interval such that the preliminary discharges are performed at a suitable preliminary discharge position in accordance with a size of the recording medium.

8. A recording apparatus according to claim 7, wherein preliminary discharge positions are located at a home position and an opposite home position, which is at a side opposite to the home position in a scanning direction of the recording head, and wherein the preliminary-discharge-time setting means sets the time interval such that the preliminary discharges are performed at one of the preliminary discharge position at the home position and the preliminary discharge position at the opposite home position, whichever one is suitable for the size of the recording medium.

9. A recording apparatus according to claim 1, wherein the recording head performs the recording operation by generating bubbles inside the ink so that the ink is discharged from the recording head by a pressure applied by the generated bubbles.

10. A recording apparatus according to claim 1, wherein the time determined on the basis of the elapsed time includes a compensation time for performing the preliminary discharges at the predetermined preliminary discharge positions.

11. A recording apparatus according to claim 1, wherein the preliminary discharge is performed based on a value determined on the basis of the elapsed time.

12. An ink jet recording method by which an operation of recording on a recording medium is performed by moving a recording head having discharge outlets for discharging an ink and which performs preliminary discharges at a plurality of preliminary discharge positions, the ink jet recording method comprising:

a preliminary-discharge-time setting step in which a time interval at which the preliminary discharges are performed is set;

an elapsed-time counting step in which the time elapsed since the previous preliminary discharge of the recording head is counted; and a comparing step in which a time determined on the basis of the elapsed time counted in the elapsed-time counting step and the time interval set in the preliminary-discharge-time setting step are compared and a preliminary discharge command is output when the elapsed time reaches the set time interval, wherein a preliminary discharge is performed at a predetermined preliminary discharge position selected from the plurality of preliminary discharge positions on the basis of at least one of the set time interval and the time determined on the basis of the elapsed time.

13. A recording method according to claim 12, wherein the time interval is set in the preliminary-discharge-time setting step by taking into account the time required for the recording head to reach a predetermined position outside the recording medium.

14. A recording method according to claim 12, wherein a plurality of recording modes are used and the time interval is set in the preliminary-discharge-time setting step in accordance with the recording modes.

15. A recording method according to claim 14, wherein, when the recording is performed in a marginless recording mode, in which recording is performed without leaving a margin in the recording medium in a scanning direction of the recording head, the time interval is set in the preliminary-discharge-time setting step such that the preliminary discharges are performed only at the preliminary discharge position at a home position.

16. A recording method according to claim 12, wherein the time interval is set to a short time in the preliminary-discharge-time setting step when using a recording medium for which image quality is important.

17. A recording method according to claim 12, wherein the time interval is set to a long time in the preliminary-discharge-time setting step when using a recording medium for which recording speed is important.

18. A recording method according to claim 12, wherein the time interval is set in the preliminary-discharge-time setting step such that the preliminary discharges are performed at a suitable preliminary discharge position in accordance with a size of the recording medium.

19. A recording method according to claim 18, wherein preliminary discharge positions are placed at a home position and an opposite home position, which is at a side opposite to the home position in a scanning direction of the recording head, and wherein the time interval is set in the preliminary-discharge-time setting step such that the preliminary discharges are performed at one of the preliminary discharge position at the home position and the preliminary discharge position at the opposite home position, whichever one is suitable for the size of the recording medium.

20. A recording method according to claim 12, wherein the time determined on the basis of the elapsed time includes a compensation time for performing the preliminary discharges at the predetermined preliminary discharge positions.

21. A recording method according to claim 12, wherein the preliminary discharge is performed based on a value determined on the basis of the elapsed time.

22. An ink jet recording apparatus which records on a recording medium by moving a recording head having discharge outlets for discharging an ink and which performs preliminary discharges at a plurality of preliminary discharge positions, the ink jet recording apparatus comprising means for switching a preliminary discharge position where the preliminary discharges are performed over the plurality of preliminary discharge positions in accordance with a recording mode.

23. A recording apparatus according to claim 22, wherein the recording mode is determined in accordance with the kind of recording medium.

* * * * *

UNITED STATES PATENT AND TRADEMARK OFFICE

CERTIFICATE OF CORRECTION

PATENT NO. : 6,808,247 B2
DATED : October 26, 2004
INVENTOR(S) : Kawatoko et al.

It is certified that error appears in the above-identified patent and that said Letters Patent is hereby corrected as shown below:

Column 3,
Line 61, “sowing” should read -- showing --.

Column 7,
Line 46, “that” should read -- than the --.

Column 8,
Line 46, “a” should read -- α --.

Column 9,
Line 37, “1.1.” should read -- 1.1 seconds. --.

Column 12,
Line 19, “the” should read -- of the --.

Signed and Sealed this

Twenty-eighth Day of June, 2005

JON W. DUDAS
*Director of the United States Patent and Trademark Office*